US007252216B2

(12) United States Patent
Lin et al.

(10) Patent No.: US 7,252,216 B2
(45) Date of Patent: Aug. 7, 2007

(54) FOOD WRAP CUTTER

(76) Inventors: Chang San Lin, 8F, No. 97 Sec. 4 Chung-Hsin Rd., Taipei (TW); Paul C. Tsay, 1115 SE. Morgan Rd., Vancouver, WA (US) 98664

( * ) Notice: Subject to any disclaimer, the term of this patent is extended or adjusted under 35 U.S.C. 154(b) by 0 days.

(21) Appl. No.: 10/816,819

(22) Filed: Apr. 5, 2004

(65) Prior Publication Data

US 2004/0194601 A1 Oct. 7, 2004

(30) Foreign Application Priority Data

Apr. 4, 2003 (TW) ..... 92107753 A

(51) Int. Cl.
*B26F 3/02* (2006.01)

(52) U.S. Cl. ..... 225/38; 83/650

(58) Field of Classification Search ..... 83/648–650; 225/19, 20, 38, 77, 91; 242/522, 523.1, 526, 242/554.2

See application file for complete search history.

(56) References Cited

U.S. PATENT DOCUMENTS 2,663,369 A * 12/1953 Erhardt ..... 225/20
3,991,923 A * 11/1976 Nishikawa ..... 225/20
4,427,144 A * 1/1984 Macgrory et al. ..... 83/650
4,586,639 A * 5/1986 Ruff et al. ..... 225/20
4,646,956 A * 3/1987 Ruff et al. ..... 225/77
6,959,635 B2 * 11/2005 Tramontina et al. ..... 83/649

* cited by examiner

*Primary Examiner*—Stephen Choi
(74) *Attorney, Agent, or Firm*—Alan Kamrath; Kamrath & Associates PA

(57) ABSTRACT

A food wrap cutter includes a base body disposed under a slot on the front wall of a main body, a guiding element with elastic moving function disposed on the base body, and a guiding wedge of the two guiding elements coupled to a cam slot at a lower panel. Thus, when the guiding element is pressed, the lower panel is lifted by the action of the guiding element on the cam groove such that the upper edge of the lower panel is higher than the upper edge of the cutter; and the guiding element drives the upper panel to lift and separate the upper and lower panels in order to protect a user's hand from being cut or scratched while pulling out the food wrap.

9 Claims, 9 Drawing Sheets

FOOD WRAP CUTTER

BACKGROUND OF THE INVENTION

1. Field of the Invention

The present invention relates to a food wrap such as a PVC wrap or an aluminum foil for storing food and a kitchenware for easily accessing and cutting the food wrap.

2. Description of the Related Art

To assure the freshness of food, prevent food from being contaminated, or cook food by baking, it is common to use food wraps to wrap food in household life or even in restaurants. In general, a food wrap usually includes a film made by PVC material or an aluminum sheet; regardless of PVC or aluminum, the food wraps are manufactured and packed in rolls and stored in a paper box for selling. Such paper box comes with a cutter with sawteeth; the wrap is pulled out to a desired length when it is in use, and the cutter will cut the food wrap. However, users have to hold the food wrap by one hand and the food or kitchenware by another hand for the sealing or packaging operation, and thus it is very inconvenient.

To overcome the aforementioned shortcoming, a so-called Food Wrap Cutter was introduced in the market, and the structure of a food wrap cutter is characterized in that the cutter has a main body with a transversally moving cutter, and the food wrap or aluminum foil is placed inside of the main body; after the wrap or foil is pulled out to a desired length, the user manually operates the cutter to move it transversally for cutting the wrap or foil. However, such a traditional food wrap cutter still has its shortcomings in that when the wrap is completely pulled out and cut by the cutter on one side, the stress is not even and the cutting end of the wrap will be softened and drooped without support, which will directly affect the evenness of the cutting, particularly for the thin and soft food wrap. When manually cutting the food wrap by the cutter transversally, the cutting end of the food wrap will curl and affect the evenness of the cutting since the width of the wrap is about 8~22 inches and the stress is uneven. In other words, a food wrap (particularly when a plastic food wrap is cut) usually produces curls, wrinkles, or tangles; users have to use hands to reorganize or spread out the food wrap. Whiling reorganizing or spreading out the food wrap by hands, the food wrap may be contaminated by foreign substances or germs on the user's hands. When food is wrapped by such a food wrap, the food may get soured or rotten easily.

Further, traditional food wrap cutters have linearly arranged sawteeth with equal heights. The design of sawteeth with equal heights causes the food wrap to have several cutting actions by the sawteeth simultaneously when the food wrap is cut from left to right or from right to left, such that the force exerted from each sawtooth onto the food wrap is reduced. As a result, the food wrap cannot be pierced easily for cutting, and it is necessary to use larger force to complete the cutting. Furthermore, the cut end is usually not even. Therefore, traditional food wrap cutters still need further improvements.

SUMMARY OF THE INVENTION

The primary objective of the present invention is to overcome the inconvenience of placing a food wrap in a package box for its direct use.

The secondary objective of the present invention is to overcome the shortcoming of traditional food wrap cutters, including its uneven cut end due to the uneven stress of the cutting and the cutting end of the wrap is softened and drooped without support, which directly affects the evenness of the cut or even the smoothness; and the cut end generally has curls or wrinkles and thus it is inconvenient for cutting and packaging.

The third objective of the present invention is to overcome the shortcoming of traditional food wrap cutter that cannot cut the food wrap successfully and evenly.

Technical measures taken to solve the foregoing problems are described as follows:

The first technical measure taken is to set and fix a cutter transversally on a main body; when the food wrap is pulled out from the main body and attached along the whole cutter, external force is exerted to cut the food wrap.

The second technical measure taken is to improve the sawtooth structure of the cutter, which includes a plurality of sawteeth with different heights arranged in intervals to make the cutting of food wrap much easier.

The third technical measure taken is to include an upper panel and a lower panel; such upper and lower panels can control their ascending and descending movements. When the upper and lower panels are ascending, the lower panel covers the rear side of the cutter to protect the user hand from being cut while pulling out the food wrap. When the upper and lower panels are descending, the upper edge of the lower panel moves to a position lower than the cutter, and the upper panel will press on the food wrap to fix the food wrap in a position.

The fourth technical measure taken is to control the abovementioned ascending and descending movements of the upper and lower panels by using both hands to simultaneously press or release a guiding element each on both sides of the food wrap cutter.

Compared with the prior arts, the present invention achieves the first objective by cutting the thin and soft food wrap or aluminum foil evenly and smoothly. The present invention achieves the second objective by conveniently pulling out, cutting, and positioning the food wrap. The present invention achieves the third objective by providing a safe protection design, and cover the rear side of the blade of the cutter before the food wrap is pulled out in order to prevent the user hand from being cut when the food wrap is pulled from the rear end towards the front.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
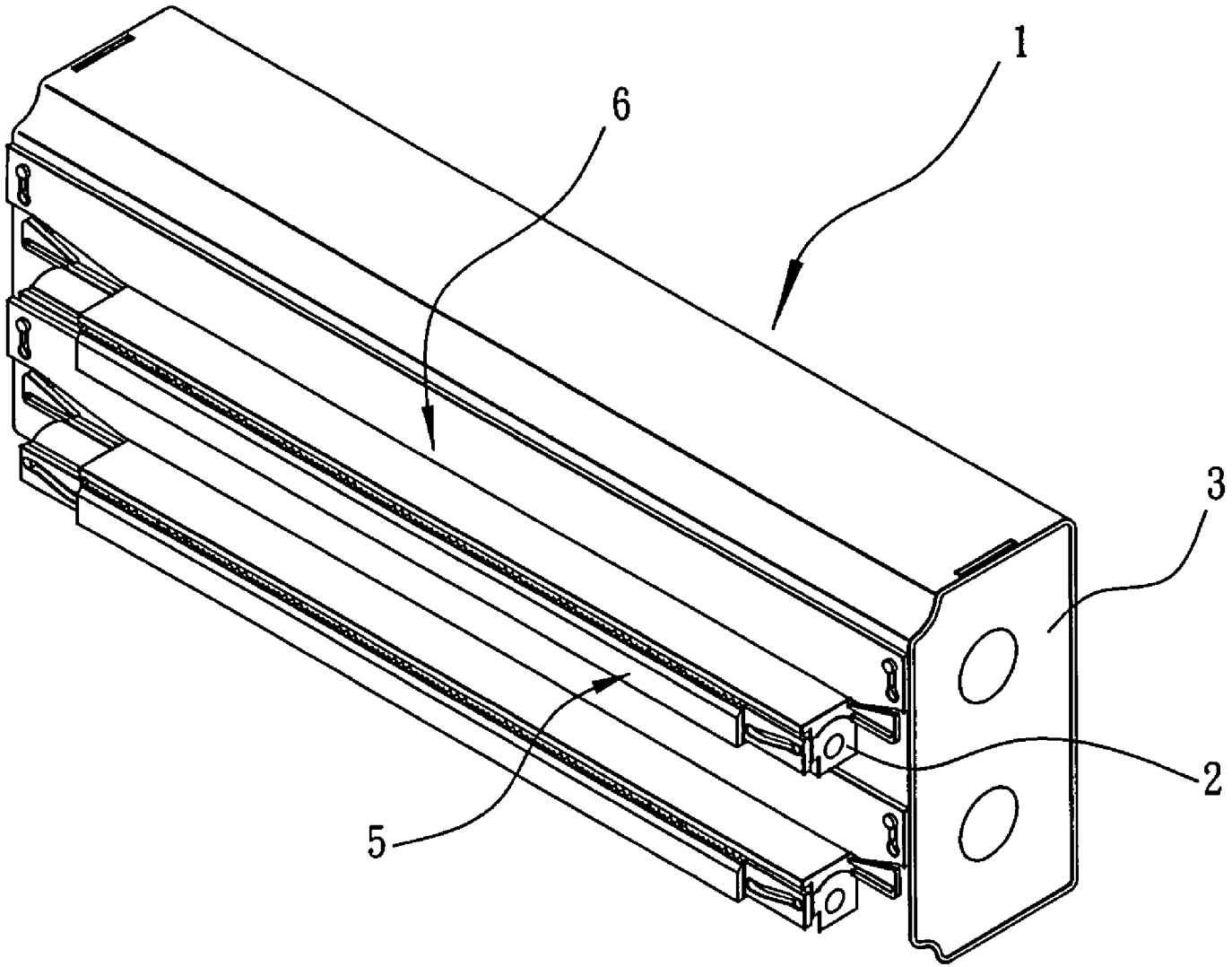
FIG. 1 is a perspective diagram of the overall appearance of the present invention.
Figure 2:
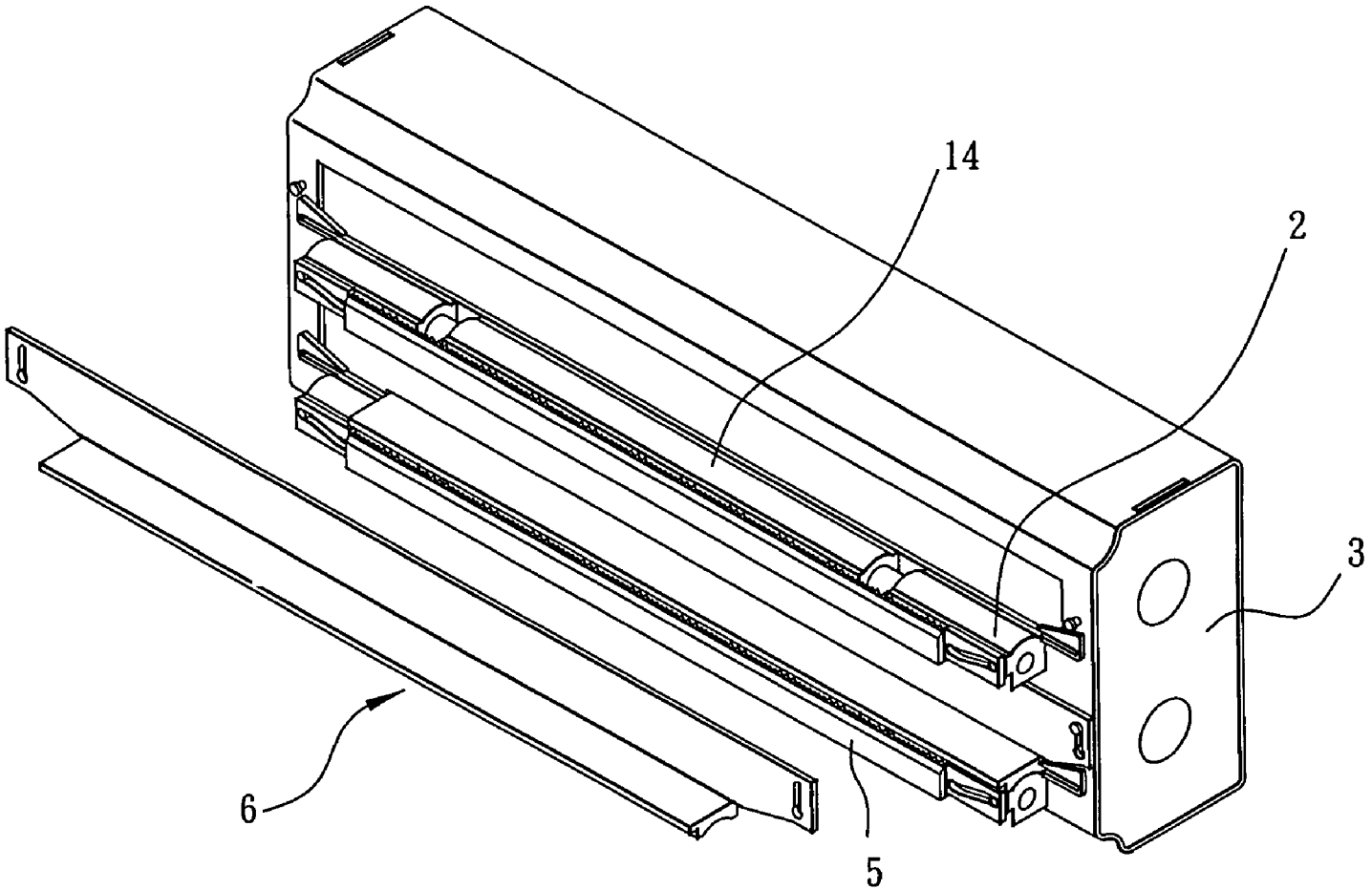
FIG. 2 is a perspective diagram of the present invention when the upper panel is removed.

Please refer to FIGS. 1 and 2. The food wrap cutter of the present invention comprises: a base body 14 disposed at the front of a main body 1; an upper panel 6 disposed above the base body 14; a cutter 5 secured at the front end of the base body 14, a guiding element 2 each disposed on both ends of the base body 14; a side board 3 each disposed on both sides of the main body 1 for sealing main body 1.

Figure 3:
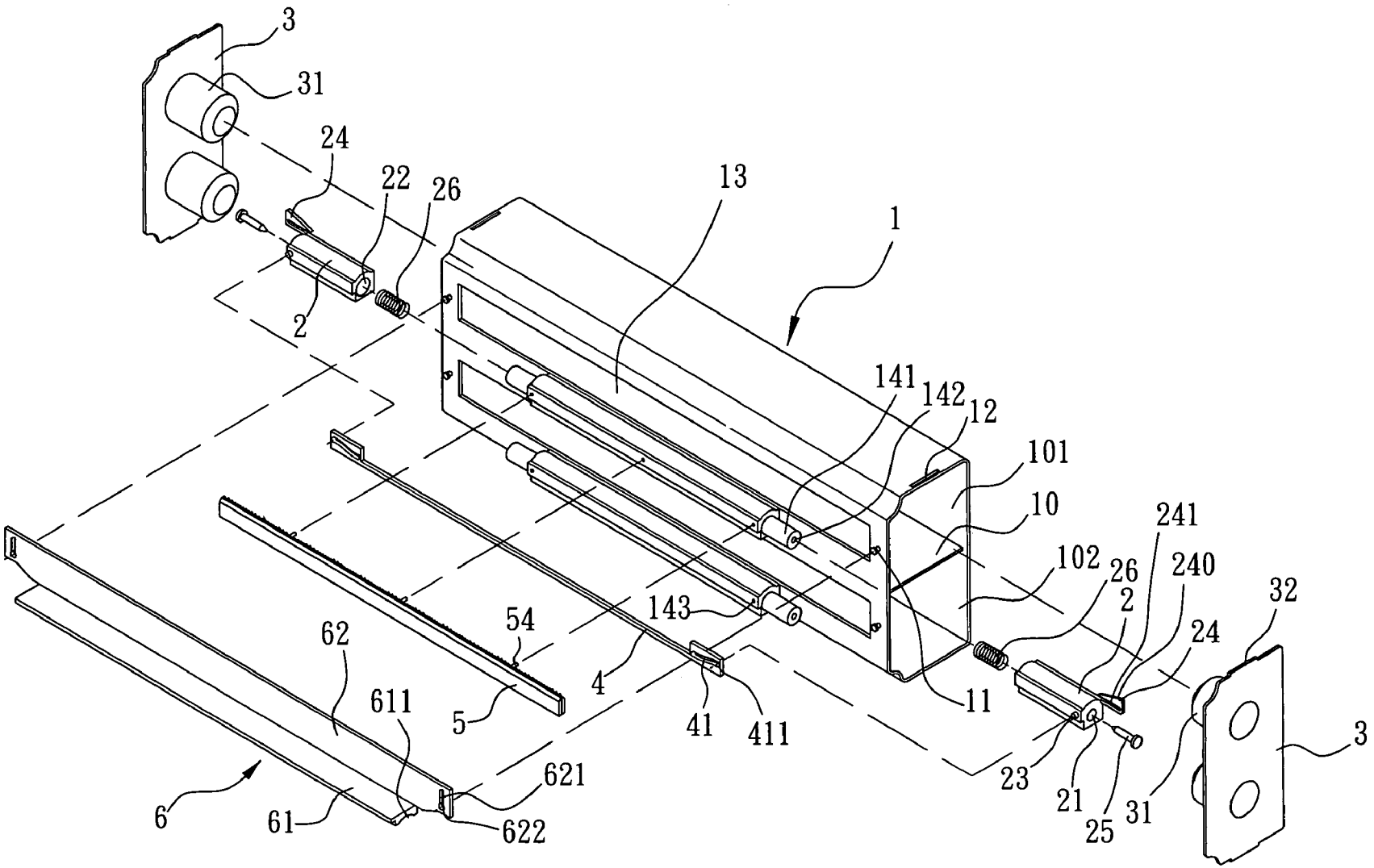
FIG. 3 is a perspective diagram of the disassembled parts of the present invention.

Please refer to FIG. 3 for further illustration of the detailed structure of the present invention. In the figure, a main body 1 is a box having a hollow space therein, and the interior of the main body 1 is partitioned into an upper space 101 and an lower space 102 by a partitioning board 10 for accommodating two different kinds of food wraps such as a PVC wrap and an aluminum foil; a slot 13 connected to the foregoing hollow space is disposed in the front sidewall of the main body 1; a base body 14 is coupled on the external sidewall of the main body 1 below the slot 13; a circular axle rod 141 is disposed respectively on each of both ends of the base body 14, and the end of each axle rod 141 has a central axis parallel to the axle rod 141 and a guiding hole 142 with an appropriate depth; and the upper surface of the base body 14 is preferably a convex curved surface. A pip 11 is disposed at an appropriate position on both sides of the front wall of the main body 1, and the pip 11 in this preferred embodiment is a cylindrical body having an integrally formed head with a larger diameter similar to a nail. Both sides of the main body 1 form hollow spaces for storing the food wraps. A latch hole 12 is disposed respectively on the upper and lower surfaces proximate both sides of the main body 1, and protrusions 32 corresponsive to such latch holes 12 are disposed respectively on the upper and lower ends of a side board 3; after the food wrap is placed, the side board 3 may be bent slightly to insert the upper and lower ends of the protrusion 32 into the upper and lower ends of the latch hole 12, and the side board 3 is used to seal both sides of the main body 1. When the food wrap is exhausted and needs refills, a cylindrical object is used to press the protrusion 32 down from the latch hole 12 at the upper section of the main body 1 to bend and remove the side board 3. An axial pillar 31 is disposed on the inner surface of the side board 3, and the axial pillar 31 is used to connect both ends of the rolled food wrap to facilitate the rolling of the food wrap inside the main body 1.

Figure 5:
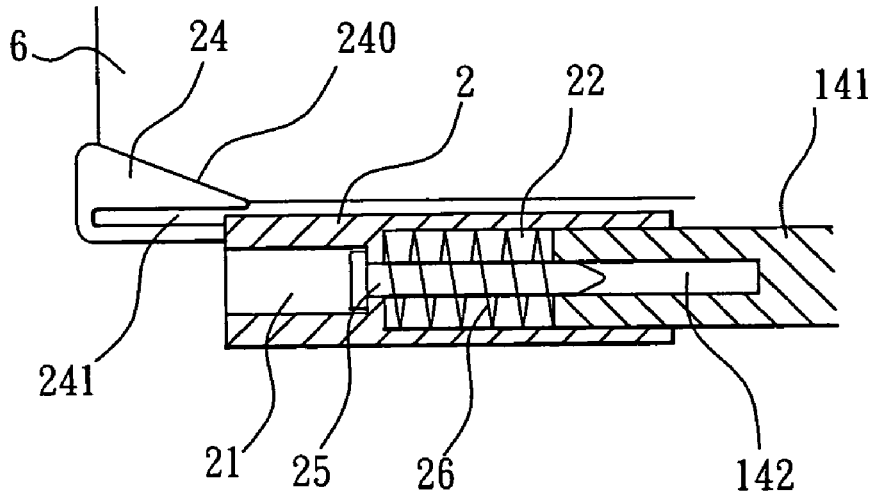
FIG. 5 is a cross-sectional diagram of the guiding element being assembled to the axle rod but not being pressed according to the present invention.
Figure 6:
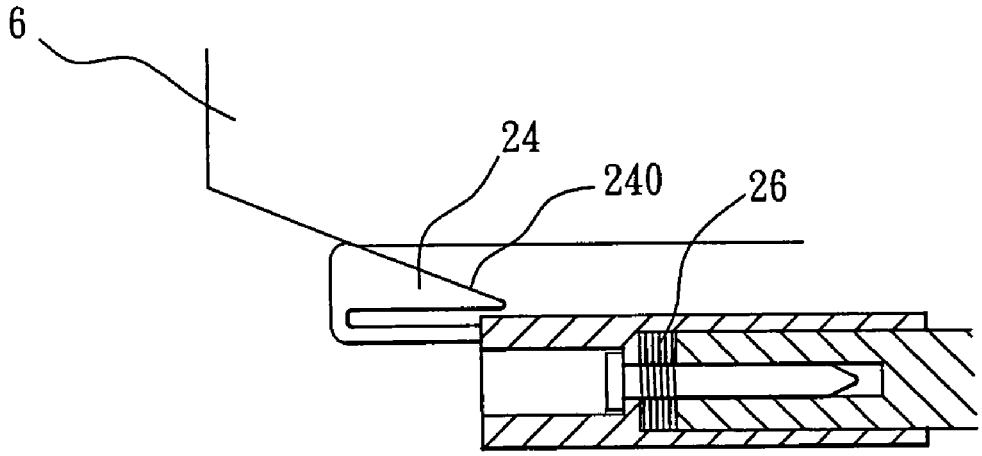
FIG. 6 is a cross-sectional diagram of the guiding element being assembled to the axle rod and pressed to lift the lower panel according to the present invention.

The present invention further comprises two guiding elements 2, two springs 26, a lower panel 4, an upper panel 6, and a cutter 5. A first hole 21 and a second hole 22 are disposed respectively on both ends of the guiding element 2, and the first and second holes 21, 22 have different diameters, but the interior of the guiding element 2 is connected with each other. The internal diameter of the second hole 22 is substantially corresponsive to the diameter of the axle rod 141. The spring 26 is placed into the second hole 22 and the axle rod 141 is passed into the second hole 22 and a wedge axle 25 is passed from the first hole 21 into the guiding element 2 and through the spring 26 into the guiding hole 142, so that the guiding element 2 is mounted onto the axle rod 141. In the meantime, the spring 26 is located between the end of the axle rod 141 and the bottom of the second hole 22. The axle rod 141 passes into the second hole 22 by adopting the sliding method so that the axle rod 141 can axially move between the guiding elements 2. A protruded base 24 is disposed on the rear side at the same ends of the guiding element 2 and the first hole 21, and the protruded base 24 has a horizontal guiding groove 241. The front sidewall of the guiding element 2 integrally forms a guiding wedge 23. When the guiding element 2 is pressed towards the base body 14, the spring 26 (as shown in FIG. 6) is compressed; when the guiding element 2 is released, the elasticity of the spring 26 resumes the original position of the guiding element 2 (as shown in FIG. 5).

Figure 8:
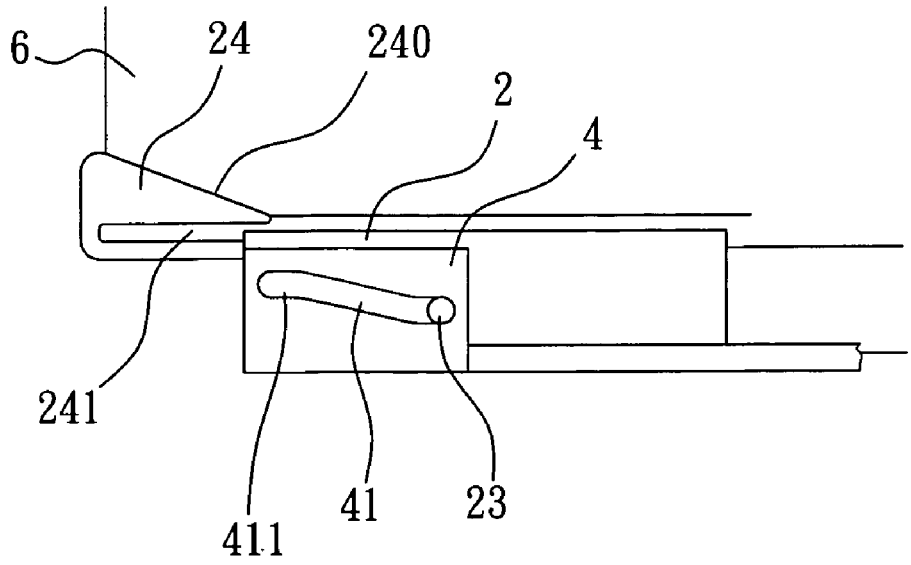
FIG. 8 is a cross-sectional diagram of the guiding element being pressed to lift the lower panel according to the present invention.
Figure 7:
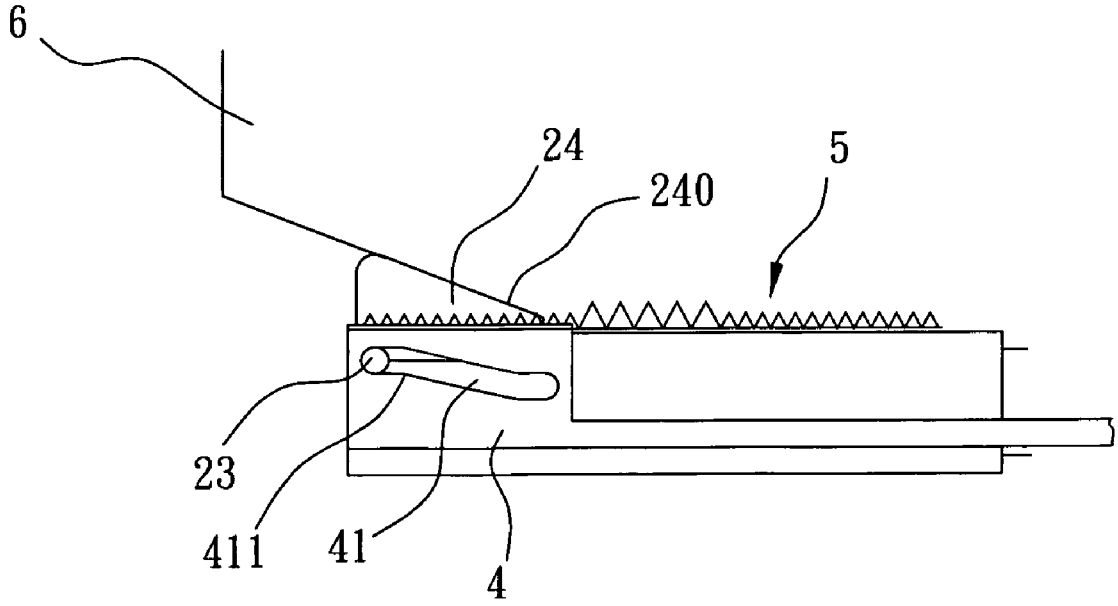
FIG. 7 is a cross-sectional diagram of the guiding element not being pressed such that the lower panel is located at the lower section according to the present invention.

The lower panel 4 is substantially in the shape of a rod, and both ends of the lower panel 4 have a larger area, and a cam groove 41 is disposed in the section with a larger area. The cam grooves 41 on both ends of the lower panel 4 are symmetrical, and each cam groove 41 is provided respectively for passing the guiding wedge 23 of the guiding element 2 for the assembly. When the spring 26 is not compressed, the guiding wedge 23 is located at a high point 411 of the cam groove 41 (as shown in FIG. 7). When the guiding element 2 is pushed to compress the spring 26, the guiding wedge 23 moves along the cam groove 41 and pushes the lower panel 4 upward (as shown in FIG. 8).

Figure 11:
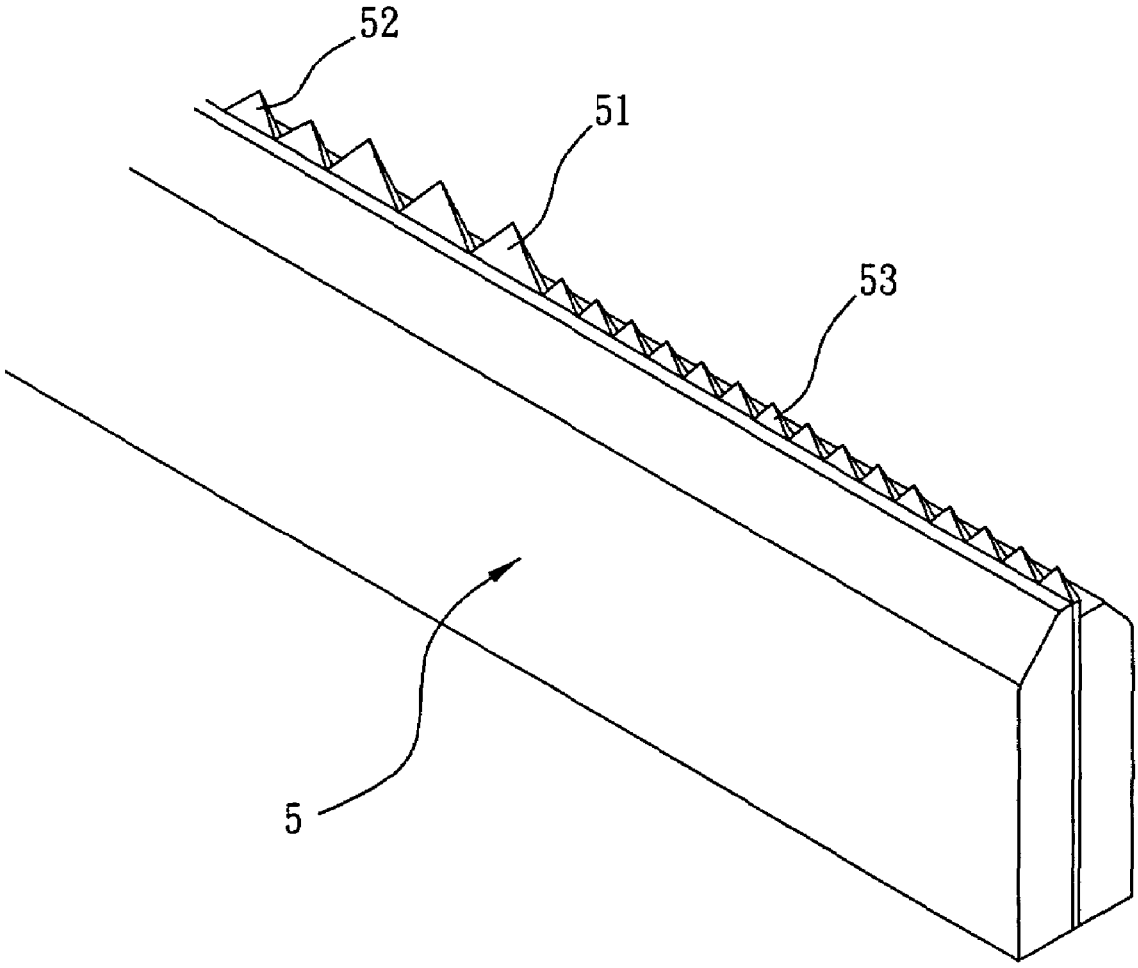
FIG. 11 is a perspective diagram of part of the serrations of the cutter according to the present invention.

The cutter 5 of the present invention has a series of sawteeth sets at the upper edge of the main body 1, and each set of sawteeth respectively has different heights. For example, the cutter of the present invention as shown in FIG. 11 has at least three kinds of sawteeth: high sawteeth 51, mid sawteeth 52, and low sawteeth 53 of different heights disposed at the upper edge of the cutter 5; wherein a plurality of high sawteeth 51 are arranged into a set of high sawteeth; a plurality of mid sawteeth 52 are arranged into a set of mid sawteeth; and a plurality of low sawteeth 53 are arranged into a set of low sawteeth. The sets of sawteeth are arranged in ascending order and then in descending order such that when the food wrap is cut linearly in the top-down direction, the food wrap is cut by the high sawteeth 51 first and then the mid sawteeth 52 and the low sawteeth 53 in order. The food wrap can then be cut smoother and evener, totally eliminating the curling and tangling problems. A plurality of insert wedges 54 are disposed on a side of the cutter 5, and these insert wedges 54 have a diameter slightly larger than the wedge hole 143 on the front wall of the base body 14, such that these insert wedges 54 are pressed into these wedge holes 143 to mount the cutter 5 onto the base body 14.

The upper panel 6 of the present invention comprises a vertical section 62 and a horizontal section 61 coupled to form a L-shape structure, and both sides of the vertical section 62 have a vertical groove hole 621 and an enlarged hole 622 disposed at the lower end of the vertical groove hole 621 such that the pip 11 of the main body 1 can pass through the enlarged hole 622 and slide into the vertical groove hole 621 such that the upper panel 6 can relatively move vertically with respect to the main body 1. The lower surface of the horizontal section 61 preferably has a concave curved surface 611 corresponsive to the curvature of the upper surface of the base body 14.

Figure 4:
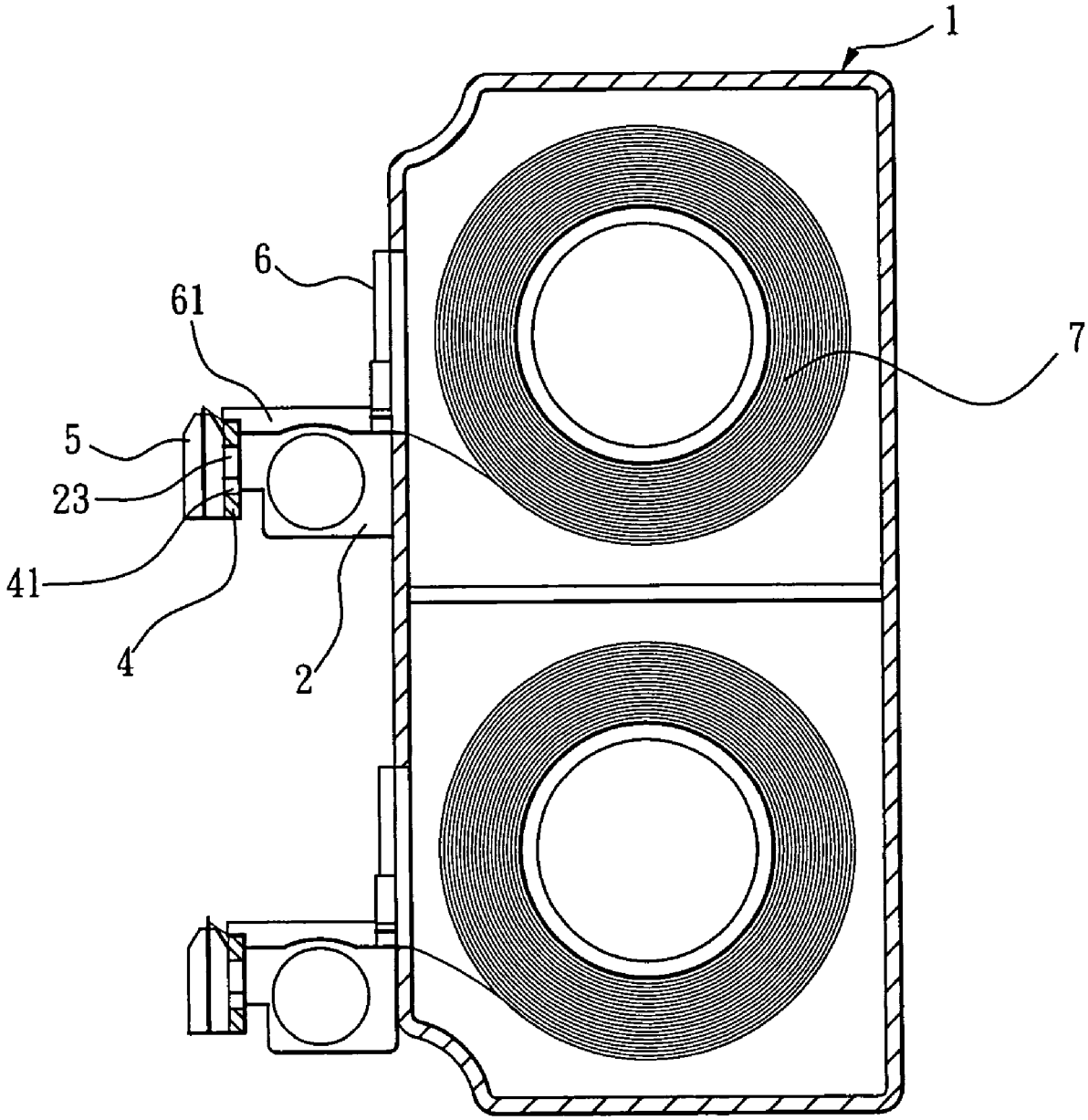
FIG. 4 is cross-sectional diagram of the side view of the assembled structure of the present invention.
Figure 9:
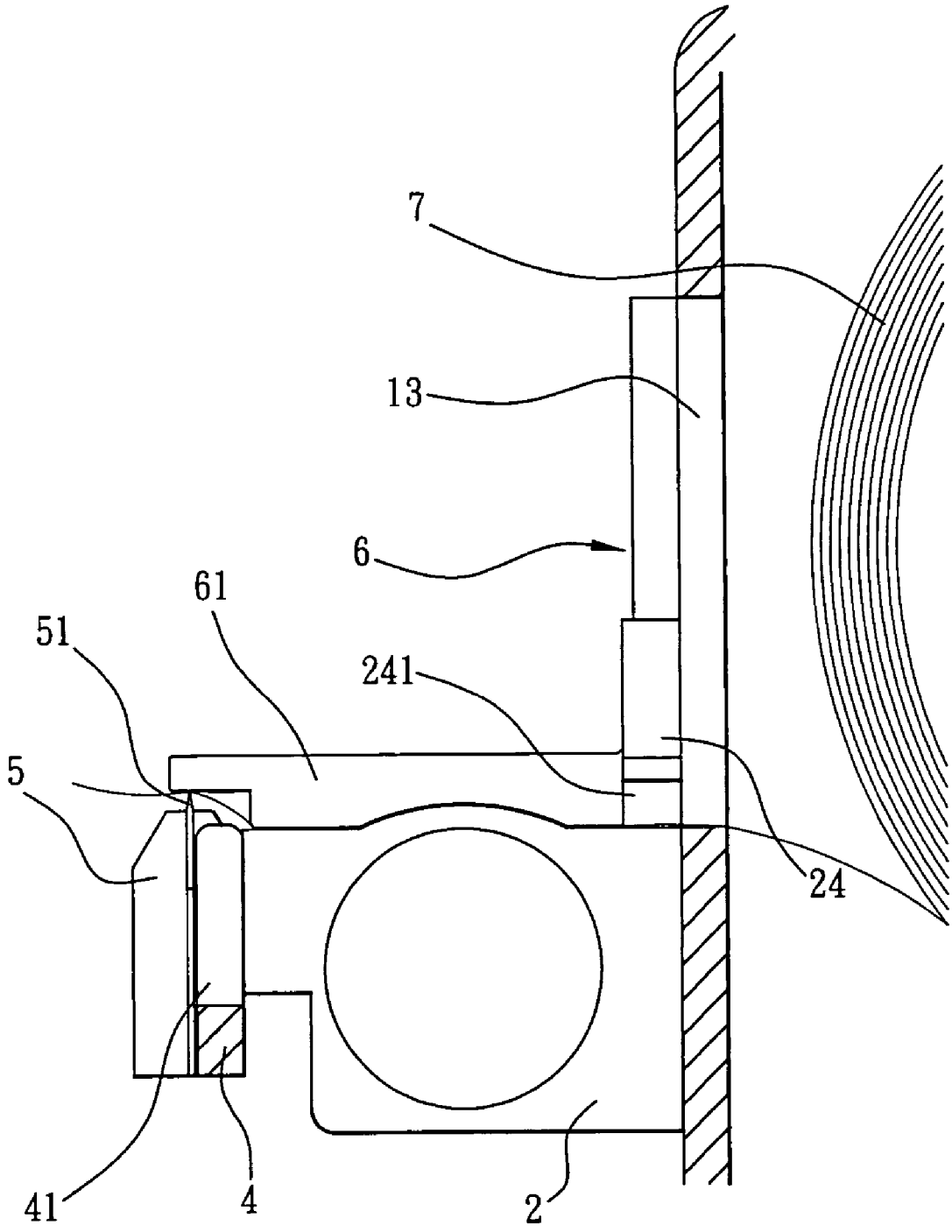
FIG. 9 is a cross-sectional diagram showing the upper edge of the lower panel is lower than the upper edge of the cutter, and the upper and lower panels are used to fix the food wrap in a position according to the present invention.
Figure 10:
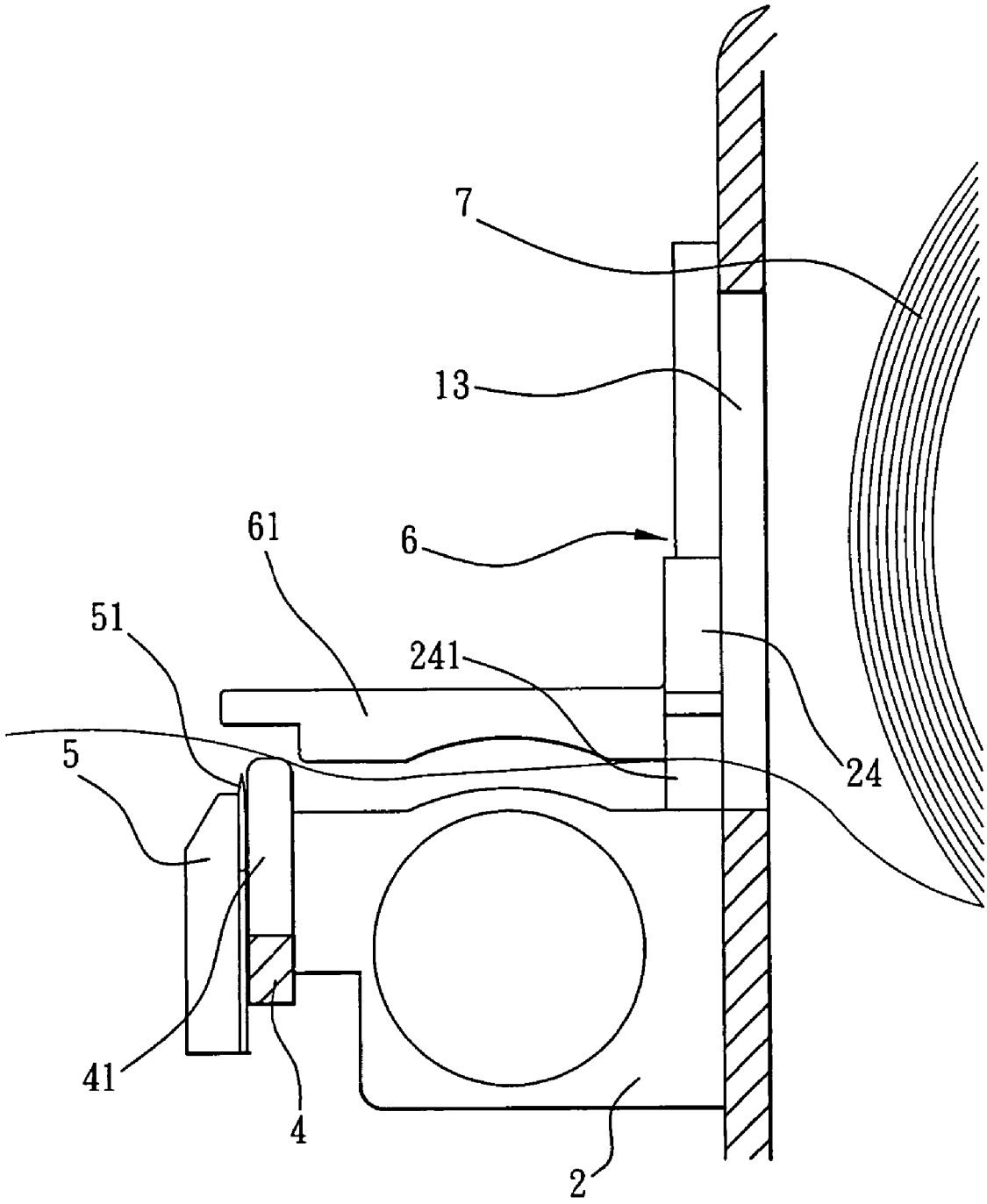
FIG. 10 is a cross-sectional diagram showing the side view of the upper edge of the lower panel being higher than the upper edge of the cutter such that the upper and lower panels are separated to facilitate the pulling out of the food wrap.

Please refer to FIG. 4 for the assembled structure of the present invention. In the figure, it simultaneously shows that the upper and lower spaces in the main body 1 can respectively store two different kinds of food wraps 7. Please also refer to FIG. 9. The food wrap 7 is pulled out from the slot 13 and passes through the guiding groove 241 of the guiding element 2 and between the upper surface of the base body 14 and the horizontal section 61 of the upper panel 6, and then passes through the lower panel 4 and the cutter 5. FIG. 10 shows that the guiding element 2 of the present invention is not compressed by external forces, the upper end of the lower panel 4 is lower than the upper edge of the sawteeth of the cutter 5, while the horizontal section 61 of the upper panel 6 proximate the upper surface of the base body 14 presses and fixes the food wrap 7 in a position and keeps the food wrap 7 from withdrawing into the main body 1. If it is necessary to pull out the food wrap 7, the user needs to push the two guiding elements 2 to axially move them nearer by both hands, and to use the movement of the guiding wedge 23 in the cam groove 241 to push the lower panel 4 upward, so that the upper edge of the lower panel 4 is higher than the upper edge of the sawteeth of the cutter 5. Such arrangement allows users to pull out the food wrap 7 towards the cutter 5 and prevents the user's hand from being cut by the cutter 5. During the moving process of the guiding element 2, the aslant surface 240 of its protruded base 24 is used to push the upper panel 6 upward, so that the lower surface of the upper panel 6 is separated from the upper surface of the base body 14 (as shown in FIG. 10) to facilitate the pulling of the food wrap 7.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A food wrap cutter, comprising:

a main body, having an interior space for accommodating a food wrap, a slot connected to said interior space being disposed at a front sidewall of said main body, a base body disposed on an outer sidewall of said main body under said slot, and an axle rod respectively disposed on both ends of said base body;

guiding elements, each being movably coupled to both ends of said axle rod, and a spring being disposed between said guiding element and said axle rod, and said guiding element having a guiding groove and a guiding wedge, and an aslant surface being disposed thereon;

an upper panel, disposed on the front sidewall above said base body;

a lower panel, having a cam groove respectively on both sides, and said cam grooves on both sides being coupled to the guiding wedges of said guiding elements;

a cutter, coupled to said base body;

when said guiding elements not being compressed by an external force, an upper edge of said lower panel being lower than an upper edge of said cutter; and when said guiding elements being compressed by an external force, said guiding wedges acting on said cam grooves such that the upper edge of said lower panel is higher than the upper edge of said cutter.

2. The food wrap cutter of claim 1, wherein said base body at the end of the axle rod comprises a guiding hole, and a first hole and a second hole mutually connected being disposed on both ends of said guiding element, and said second hole being corresponsive to said axle rod, thereby after said spring being placed in said second hole and inserting into said first hole with a wedge axle and then passing into said guiding hole to mount said guiding element onto said axle rod.

3. The food wrap cutter of claim 1, wherein said guiding element comprises a protruded base with said aslant surface formed thereon, and said guiding groove is disposed on said protruded base.

4. The food wrap cutter of claim 1, wherein said upper panel comprises a vertical section and a horizontal section; said vertical section having a vertical groove hole, and said vertical groove hole at its lower end having an enlarged hole; a pip being disposed on the front wall of said main body, and the end of said pip having a head slightly smaller than said enlarge hole such that said, pip passing through said enlarged hole and sliding into said vertical groove hole.

5. The food wrap cutter of claim 1, wherein said cutter has a plurality of sawteeth sets with different heights, and said sawteeth sets are arranged in the sequence from high to low and then from low to high.

6. The food wrap cutter of claim 5, wherein said cutter comprises a high sawteeth set, a mid sawteeth set, and a low sawteeth set, of which said high sawteeth set being comprised of a plurality of high sawteeth, said mid sawteeth set being comprised of a plurality of mid sawteeth, and said low sawteeth set being comprised of a plurality of low sawteeth.

7. The food wrap cutter of claim 1, wherein said main body has hollow spaces on both sides for placing a food wrap and installs a side board in said hollow spaces.

8. The food wrap cutter of claim 1, wherein said main body proximate upper and lower surfaces respectively comprises a latch hole and upper and lower ends of a side board respectively have a protrusion corresponsive to said latch hole such that said protrusion is inserted into said latch hole to mount said side board onto said main body.

9. The food wrap cutter of claim 1, wherein a vertical wall of the base body comprises a plurality of wedge holes, and a vertical wall of the cutter comprises a plurality of insert wedges corresponsive to said plurality of wedge holes such that said insert wedges is inserted into said wedge holes to mount said cutter onto said base body.

* * * * *